US006381754B1

(12) United States Patent
Ezenekwe

(10) Patent No.: US 6,381,754 B1
(45) Date of Patent: May 7, 2002

(54) HEADGEAR SYSTEM

(75) Inventor: Frank Nonso Ezenekwe, 57 Crescent Tower, Brindley Drive, Birmingham (GB), B1 2NJ

(73) Assignee: Frank Nonso Ezenekwe, Carson, CA (US)

( * ) Notice: Subject to any disclaimer, the term of this patent is extended or adjusted under 35 U.S.C. 154(b) by 0 days.

(21) Appl. No.: 09/413,973

(22) Filed: Oct. 7, 1999

(51) Int. Cl.[7] ..... A42B 1/00
(52) U.S. Cl. ..... 2/195.4; 2/183
(58) Field of Search ..... 2/195.2, 209.12, 2/195.3, 195.4, 175.1, 183, 195.1

(56) References Cited

U.S. PATENT DOCUMENTS 1,423,829 A * 7/1922 Carlson ..... 2/195.1
RE15,815 E * 4/1924 Trau ..... 2/195.1
1,494,929 A * 5/1924 Ostrove ..... 2/195.1
4,864,662 A * 9/1989 Frank ..... 2/183
5,142,705 A * 9/1992 Edwrds ..... 2/418
5,161,259 A * 11/1992 Shorts ..... 2/199

* cited by examiner

*Primary Examiner*—Bibhu Mohanty
(74) *Attorney, Agent, or Firm*—Frank Ezenekwe

(57) ABSTRACT

This invention relates to a headgear system comprising a baseball styled hat with adjustment means at the front of the crown, above the brim, in the form of straps wrapped around the crown. It also features plastic molded, baseball styled caps, visors, berets and summer hats provided with cooling elements in the form of vacuum-like pockets with sealed coolants.

5 Claims, 3 Drawing Sheets

HEADGEAR SYSTEM

BACKGROUND OF THE INVENTION

This invention relates to various headgear with a baseball styled cap, a beret, summer hat and visor.

Baseball cap styled hats are very popular as casual and sports headwear, comprising of a few panels that collectively make up the crown to which a brim is attached at the front base. This style of hat usually has an adjustable strap at the back section of the crown.

A beret is a hat without a brim comprising of a crown which sits on a band that fits around the head, the summer styled hat comprises of a cylindrical crown with a fully circular piece attached to its base. The visor on the other hand usually comprises of a headband attached to forehead front section of the crown with a brim on its base.

Figure 1:
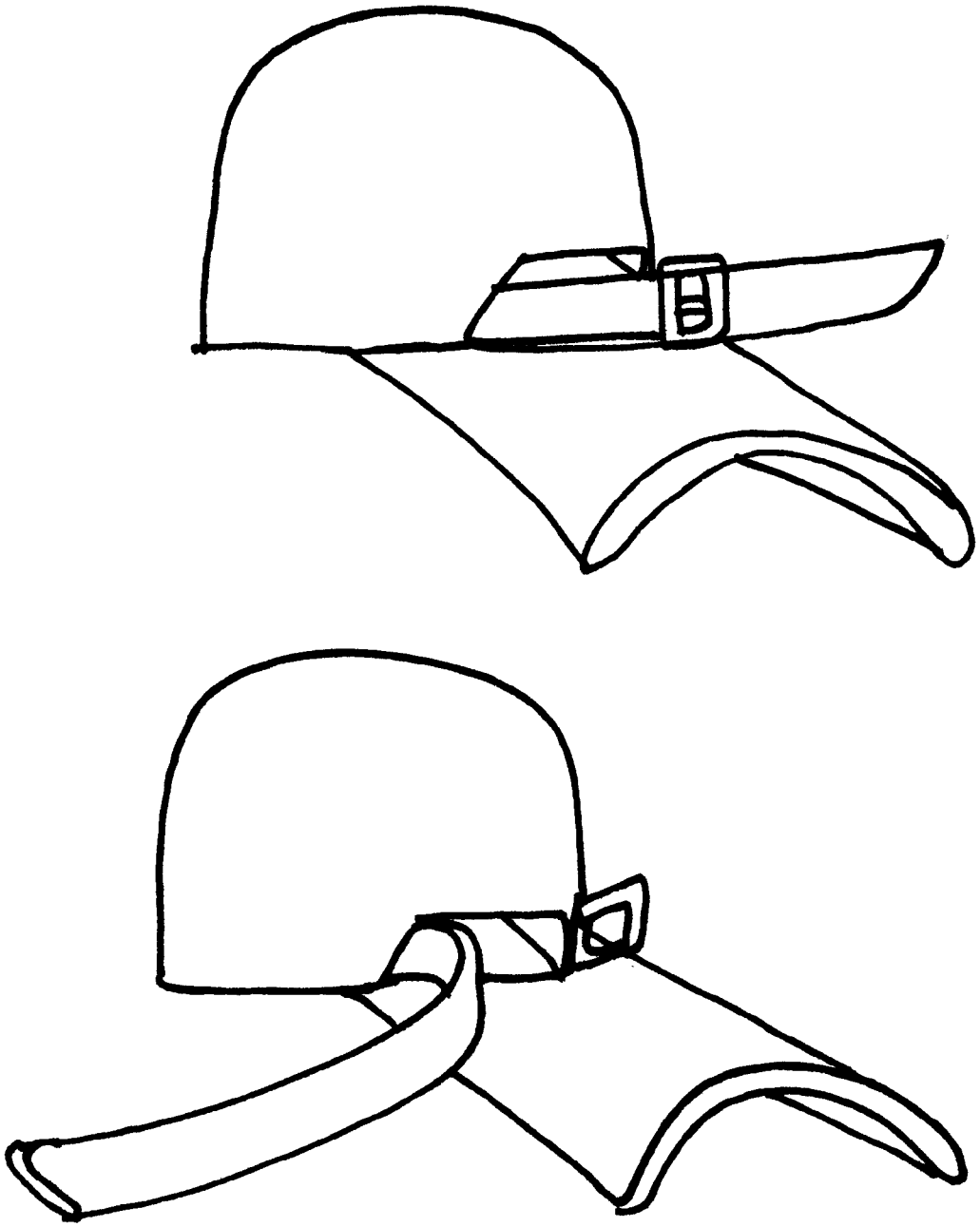
FIG. 1 show a first series of embodiments of the invention.
Figure 2:
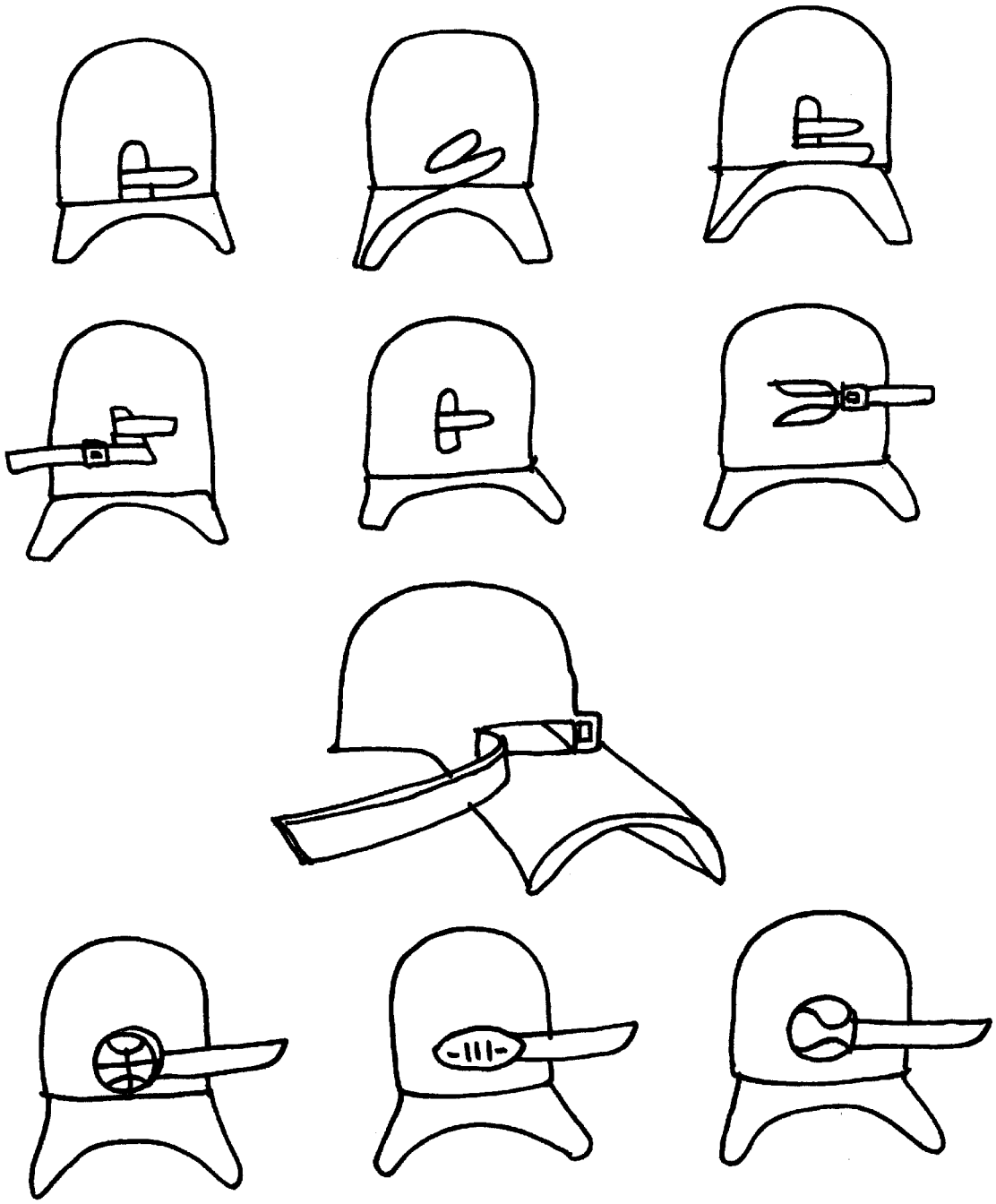
FIG. 2 shows a second series of embodiment of the invention.
Figure 3:
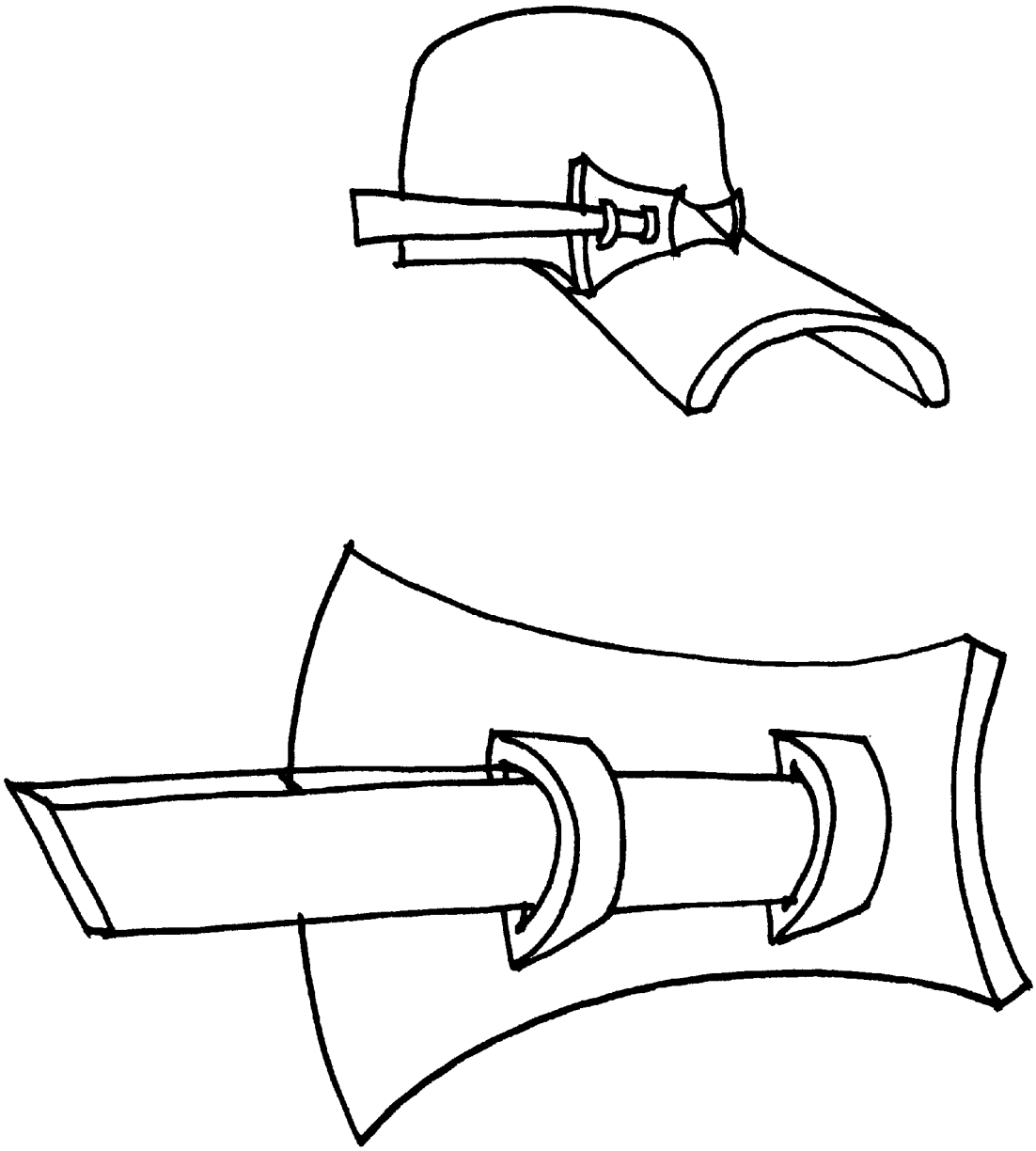
FIG. 3 shows a third series of embodiments of the invention.

According to the present invention, with respect to the baseball cap styled hat there is provided an adjustable means, on the front, forehead section of the crown above the brim. The adjustable means is in the form of one or more 'wrap across' straps which folds along the base of the crown, or across the front of the crown, leaving some room, an aperture of a reasonable size, shape, design or form above or in between the straps which locks onto the surface of the crown by means of a buckle, velcro or by any other means. The strap may be of any shape or inclination, it may reside horizontally, or to an angle across the face of the crown and it may also carry various ornaments some of which may be attached to the crown. The material used in this case may vary from cotton to synthetics and plastics, in which case they would be moulded in parts or in one piece.

In another application to the baseball cap styled hat, there is provided an adjustable means in the front of the crown above the brim. It comprises one or more expandable straps attached to any vertical side of the aperture, in between which the strap, when pulled across with a horizontal force central to the sides of the crown, gathers it. It can then be tightened to the required fit and locked on the opposite side by means of buckle, velcro or any other locking means. The straps or strap in this instance may be attached with moulded or non moulded elements of any design, shape or material, preferably plastic or metal based elements which may clip on the strap, or be fitted with grooves through which the strap may pass to carry them.

The material for the hat's crown and brim in this instance, may be stretchable or non-stretchable.

In a different application to the baseball cap styled hat, there is provided a hat made from a plastic mould comprising a crown with projecting or embedded vacuum-like pockets filled with cooling chemicals, reacting as coolants to changing temperatures and sealed like air tight bubbles. The crown also comprises on the two sides above the wearer's ear, one or more small openings about an inch wide that act as fish gills, letting air into the side of the hat. This headwear system may be provided with any of the above mentioned means of adjustment. Its brim, which projects outwards from the front base of the crown, comprises elevated blocks or subtly shaped grips along the top surface of the edge.

A downward projecting pointer underneath the outer, centre part of the brim with a hole about 1 cm in diameter going through it. The material in this instance, plastics, is waterproof and may be transparent, luminous, tinted or shaded. Also provided is an inner lining along the base of the base of the crown.

In reference to the summer hat, the present invention provides an adjustable means in the form of a stretchable strap or band between an aperture of any shape or design. It also provides a moulded plastic version which comprises of projected or embedded cooling elements along the base of the crown.

With reference to the beret styled hat, this invention provides a beret made of a plastic mould and comprising of cooling elements along the base, band area underneath the crown. Also provided are air openings in the back and side sections of the hat.

According to this invention with reference to the visor, there is provided a headband, a forehead crown piece with cooling elements, a brim attached to its base and adjustable means on the side of the band.

What is claimed is:

1. A baseball cap styled hat with a crown and a brim with an adjustable means on the front, forehead section above the brim, the adjustable means comprising at least one strap which folds along the base of the crown or the front of the crown, and an aperture of reasonable size, above or in between the at least on strap and fastening means which locks the strap onto the surface of the crown.

2. A baseball cap styled hat as claimed in claim 1, where the at least one strap is placed horizontally, vertically, or diagonally across the crown, and further comprising ornaments on the straps.

3. A baseball cap styled hat as claimed in claim 1, wherein the fastening means is a buckle or hook and loop fasteners.

4. A baseball cap styled hat as claimed in claim 1, wherein the straps are molded or non-molded.

5. A baseball cap styled hat as claimed in claim 1, where the straps pass through grooves or loops.

* * * * *